United States Patent [19]

van Riemsdijk et al.

[11] Patent Number: 4,663,603

[45] Date of Patent: May 5, 1987

[54] WINDING SYSTEM FOR AIR-COOLED TRANSFORMERS

[75] Inventors: Gerardus A. van Riemsdijk, Nijmegen; Fredericus F. M. Muller, Bergen, both of Netherlands

[73] Assignee: Holec Systemen en Componenten B.V., Hengèlo, Netherlands

[21] Appl. No.: 808,662

[22] Filed: Dec. 12, 1985

Related U.S. Application Data

[63] Continuation of Ser. No. 554,834, Nov. 23, 1983, abandoned.

[30] Foreign Application Priority Data

Nov. 25, 1982 [DE] Fed. Rep. of Germany ..... 3243595

[51] Int. Cl.[4] ..... H01F 15/04

[52] U.S. Cl. ..... 336/60; 336/70; 336/84 C; 336/150; 336/180

[58] Field of Search ..... 336/69, 70, 84 R, 84 C, 336/60, 180, 182, 183, 150

[56] References Cited

U.S. PATENT DOCUMENTS

| | | | |
|---|---|---|---|
| 1,034,929 | 8/1912 | Reynders et al. | 336/70 |
| 3,654,543 | 4/1972 | Isogai et al. | 336/70 X |
| 3,675,175 | 7/1972 | Dutton | 336/84 C X |

FOREIGN PATENT DOCUMENTS

| | | | |
|---|---|---|---|
| 415414 | 8/1934 | United Kingdom | 336/70 |

*Primary Examiner*—Thomas J. Kozma
*Attorney, Agent, or Firm*—Felfe & Lynch

[57] ABSTRACT

A winding system for gas-cooled transformers, comprising windings disposed around a core; and at least one insulation torus, consisting of an insulating mass, said torus having embedded therein electrodes electrically connected to an adjoining winding for suppression of the electric field intensity between sinding and electrodes. The winding connected to the electrodes is divided into separate winding sections across the height of the winding, and each of these sections is connected to one electrode.

11 Claims, 26 Drawing Figures

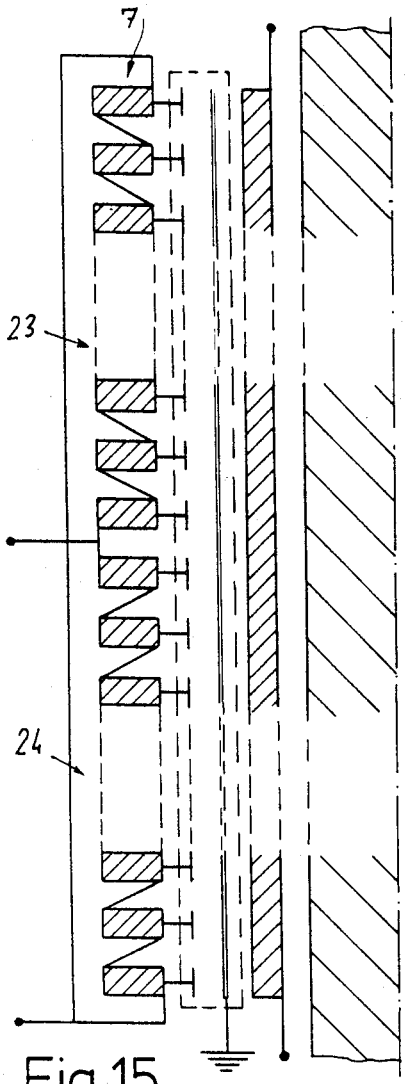
Fig.15
Fig.14
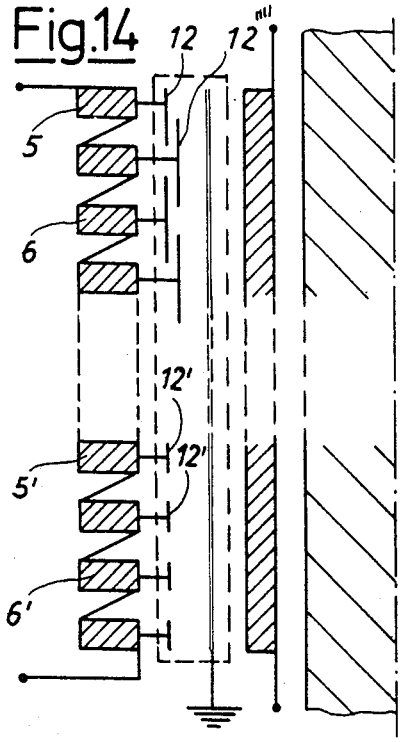
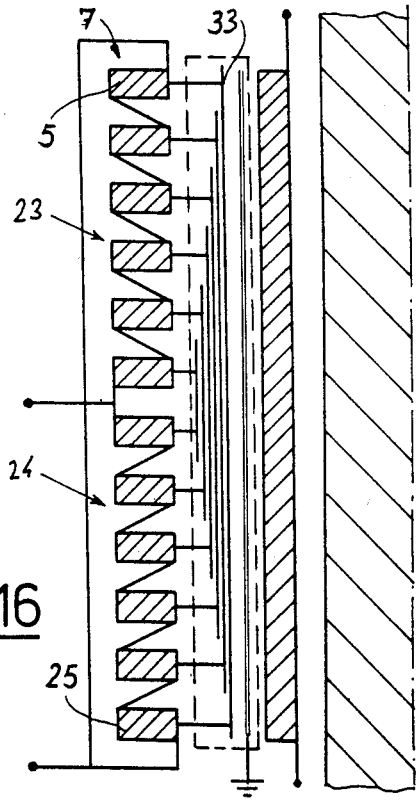
Fig.16

WINDING SYSTEM FOR AIR-COOLED TRANSFORMERS

This application is a continuation, of application Ser. No. 554,834, now abandoned filed Nov. 23, 1983.

The present invention relates to a winding system for gas-cooled transformers and the like, said transformers having at least one winding disposed around a core, and at least one insulation torus, consisting of an insulating mass, the compound of said torus having embedded therein electrodes electrically connected to an adjoining winding for the suppression of the electric field intensity between winding and electrodes.

The electrodes electrically, relieve gas-containing cooling channels adjoining the winding or adjoining gas layers such that the insulation between the high-voltage and low-voltage windings or between the winding and the core or other grounded portions belonging to the winding, is effected primarily by the insulation torus. In this connection, gas comprises air, other gases, gas mixtures or vaporous media.

It is already known from Swiss Pat. No. 240,040 to use, in a liquid-cooled transformer, an insulation cylinder provided with capacitor coatings for electrical field suppression. This insulation cylinder is positioned between at least one winding and the main insulation cylinder providing for primary insulation between high-voltage and low-voltage windings, at the side of the cooling channel remote from this winding. The capacitor coatings are connected to the ends of the respective winding.

A drawback of this structure resides in the fact that the voltage differences encountered between the individual capacitor coatings and the adjacent portions of the winding, except at the winding ends where these voltage differences are equal to zero, are not only different for each winding construction and each structure of the capacitor coatings, but also vary for a given winding system in response to the operational and test voltages. These voltage differences may become extremely high in a position at approximately one-half of the winding height under high impulse test voltages.

In addition, a cooling channel of sufficient width for cooling may be too small to insulate voltages occuring between the individual winding sections and the adjoining individual capacitor coatings. Accordingly, the voltage differences determine the cooling channel width of the winding system and necessitate expensive transformer constructions.

Further, in air-cooled transformers having the winding system according to Swiss Pat. No. 240,040, the gas layer which is always present between the insulation cylinder effecting the main insulation and the adjacent insulation cylinder provided with capacitor coating is subject to high electrical load at higher voltages. Thus, corona discharge must be expected to occur, which might result in electric breakdowns.

Therefore, the winding system according to the above Swiss patent is not suitable for air-cooled transformers operating at higher voltages.

It is accordingly the object of the invention to construct a winding system of the type as outlined at the beginning in such a manner that, on the one hand, it is possible to have the gaseous cooling medium to flow directly around the windings, while, on the other hand, it is possible to generate with minimum cooling channel widths a relatively high electric voltage between a pair of windings or between the winding and the core or other grounded portions included in the winding, respectively.

According to the present invention, this technical object is solved in a winding system for air-cooled transformers, inductors or reactors and the like in that the winding of the transformer or the like is gas-cooled; and in that the winding is divided into separate winding sections along the height of the winding, each winding section being connected to an electrode embedded in an insulation torus for the winding.

In these respects, it is generally postulated that the insulation torus is assembled to be continuous or without separation or joints.

A particular feature is that the spacing of the embedded electrodes is dimensioned to be sufficient that with the specific winding voltages to be expected (permanent load voltages and test voltages) electric breakdowns are prevented from occuring between adjacent electrodes connected to winding sections of the same winding, as well as between these electrodes and adjacent electrodes not connected to said winding, or shields.

Unlike the prior art in which a "capacitor wrap" is connected to the starting and end points of the winding only, in the invented winding system the winding is divided into winding sections which are each electrically coupled to an embedded electrode, such that the cooling channel or the gas layer between the winding and the connected electrodes is substantially free of electric field under all conditions of operation and test.

Preferably, the electrodes comprise circular rings which fully or almost fully surround the core of the winding. Alternatively, the electrodes may comprise separate, open sector-shaped circular ring sections. There may be used, for example, rings of a solid profile, electrodes of metal foil or of bent sheet metal pieces, of wire mesh, as well as electrodes made of conductive paper or conductive enamel, etc.. The conductivity of the material of the electrodes and of the leads to the electrodes is not critical; the material should be at least of weak conductivity and in order to avoid formation of hairline cracks, should have the same thermal expansion coefficient as the material of the torus structures into which it is embedded, if possible. Preferably, a single potting compound, e.g. epoxide resin, is used for the torus and the remaining parts of the air-cooled transformer.

In particular, it is further possible to embed into the compound or body of the insulation torus a non-magnetic shield, which faces the electrodes, i.e. on the side thereof opposite the winding, and with a spacing from the electrodes for electrical isolation therefrom, and which circumferentially extends around, or almost extends around the winding and, optionally divided into sections, extends along the height of the winding. Shields of this type have the function of, for example, reducing the electric field intensity on the side of the insulation torus at the adjacent side of the shield, i.e. opposite the winding.

For reasons of safety, a grounded shield may be employed in an insulation torus between a pair of rows of electrodes which are connected to a pair of different windings.

A non-grounded shield within an insulation torus of the above-defined configuration may be used, for example, for measuring or test purposes.

Further features to which the subclaims are also directed, are explained below in greater detail by referring to the drawings, wherein:

FIG. 14 illustrates an embodiment comprising a composite arrangement of overlapping and non-overlapping electrodes;

FIG. 15 shows an air-cooled transformer the high-voltage winding of which is realized with a pair of parallel branches;

FIG. 16 shows an embodiment similar to that of FIG. 13, but with mutually overlapping electrodes;

The embodiments explained below are directed primarily to gas-cooled ("dry") transformers. However, the details disclosed may be employed mutatis mutandis also for gas-cooled inductors or reactors, magnetic coils and the like, as implied also in the claims.

Figure 1:
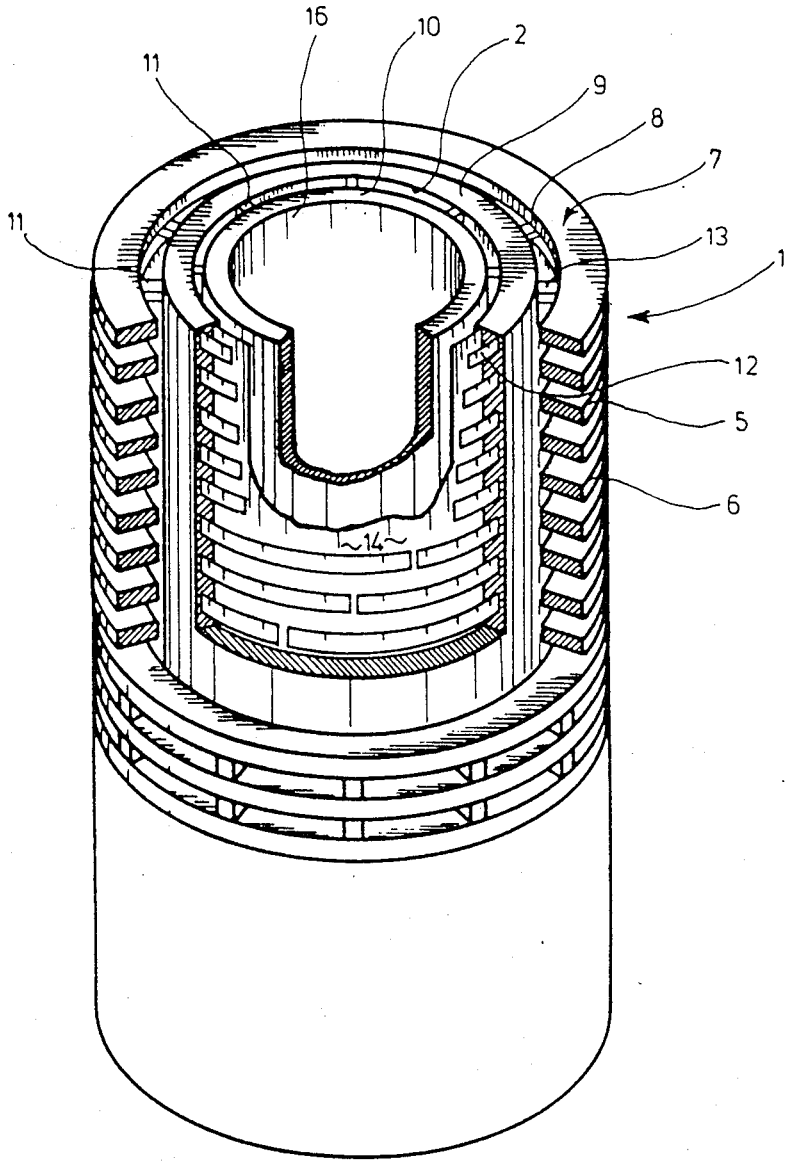
FIG. 1 is a perspective, partly sectional view of a complete transformer coil including two windings, an insulation torus, electrodes and a shield or screen.
Figure 2:
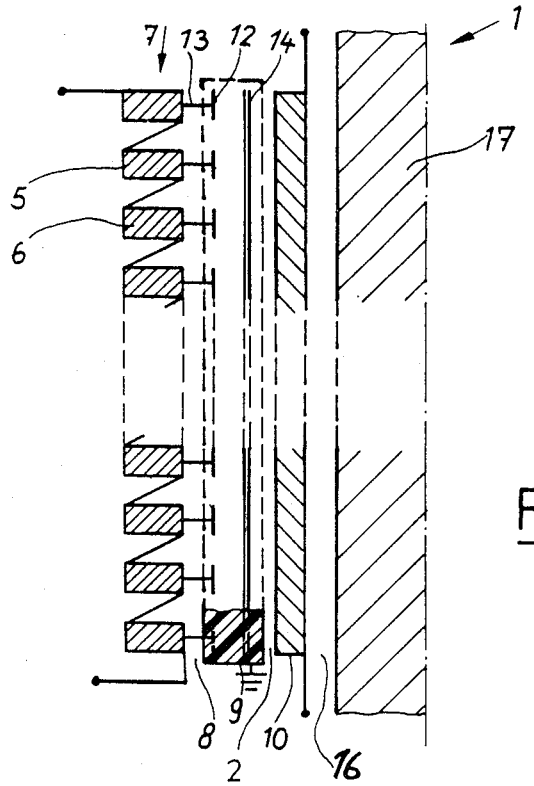
FIG. 2 is a schematical view of an embodiment of the complete transformer coil according to FIG. 1 including a grounded shield.

FIG. 1 shows in perspective view, and FIG. 2 shows in schematical view, a principal embodiment in the form of a phase section 1 of an air-cooled transformer which by dimension and configuration is generally similar to the conventional mains or power transformers. The phase section 1 is provided with (outwardly) extended terminals (not shown in FIG. 1). The high-voltage terminals, forming part of the terminals, are electrically connected to a high-voltage winding 7 comprising separate winding sections 5, 6. The series-connected winding sections 5, 6 of the high-voltage winding 7 are directly surrounded by the cooling gas in the embodiment shown, i.e. these sections are not embedded into an insulation compound.

An insulation torus 9 is separated from the high-voltage winding 7 by a cooling channel 8 at the side remote from the core, and from the low-voltage winding 10 by a cooling channel 2 at the side adjacent the core. The core is identified by numeral 17 in FIG. 2.

Embedded in the body or compound of the insulation torus 9 are annular, non-closed electrodes 12 which are each connected to a winding section 5 or 6, respectively, through a lead 13. In the present instance, each winding section is connected to one of the mentioned electrodes 12.

In the embodiments according to FIGS. 1 to 5, the compound of the insulation torus 9 has embedded therein, as spaced from the electrodes 12 and electrically isolated therefrom, an electrically conductive, non-magnetic screen or shield 14 which circumferentially surrounds the core and which includes a narrow gap (not illustrated) extending from above to below, such that there is present a discontinuity of conductivity extending across the height. FIG. 2 schematically shows a grounded shield 14. The shield may be also connected to the low-voltage winding if the latter is designed to bear a low voltage.

Figure 3:
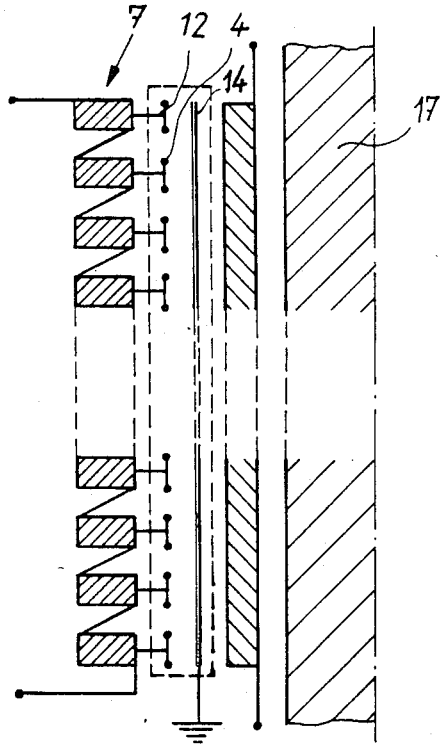
FIG. 3 shows an embodiment similar to that of FIG. 2, but with rounded electrodes.

In order to reduce the electric field strength or intensity at the electrode edges 4, these edges may be rounded (compare FIG. 3).

Figure 4:
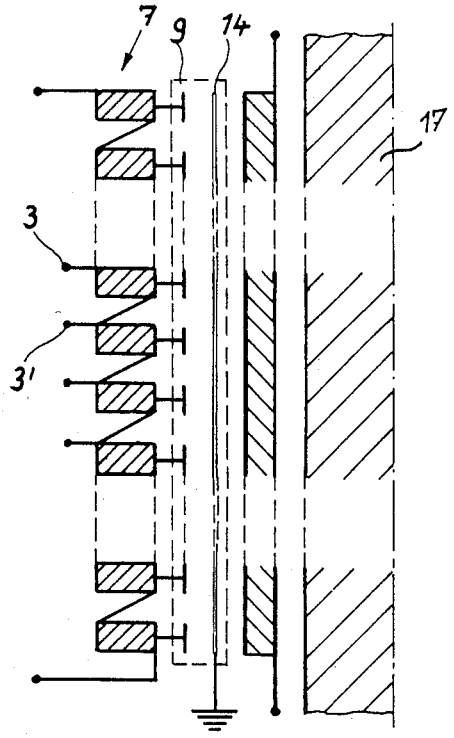
FIG. 4 shows an embodiment similar to that of FIG. 2, but including taps of the high-voltage winding.
Figure 5:
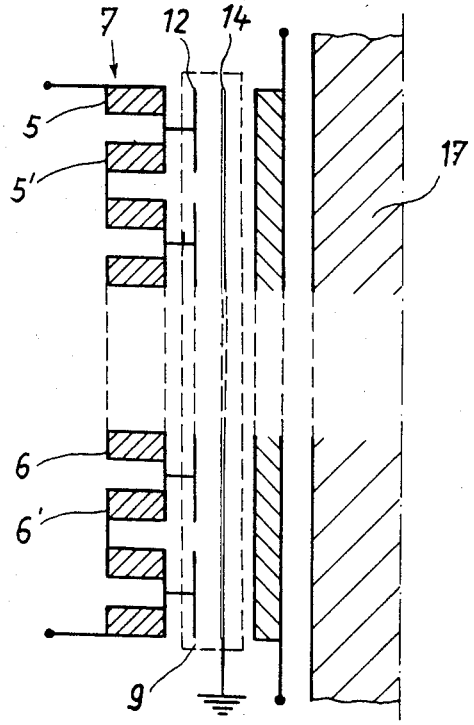
FIG. 5 shows an embodiment similar to that of FIG. 2, but with differently combined winding sections.

For voltage control, the high-voltage winding 7 may be designed to include taps 3, 3' (see FIG. 4). Control of electric field intensity existing within the insulation torus is not varied when the connection between the taps is varied.

Unlike the embodiments illustrated in FIGS. 1, 2 and 3, it is also possible (see FIG. 5) to combine winding sections 5, 5' or 6, 6' into pairs each, and connect them in bundles to an electrode 12 which is embedded in the insulation torus 9.

The shield 14 is likewise embedded in the insulation torus 9, i.e. the shield may be positioned in the interior of the insulation torus or may contact the sheath of the insulation torus. The shield 14 is formed, for example, of fine metal wire mesh, such as of fine copper wire, having a mesh size of from 1 to 2 mm. Decisive to the mesh size are the electric field intensity at the shield and the production conditions for the method of embedding in the body or compound of the insulation torus. Instead of being formed of a metal wire mesh, a shield 14 may be plated or galzanized on the inner face of the potting compound shell, or adhered or otherwise applied thereto. In the place of a shield of pure metal, corresponding alloys may be used, too; other conductive materials, such as graphite, are also useful. The conductive coating may be provided with perforations or discontinuities in order to, for example, improve the adherence. In any case, a well-balanced distribution between open and closed areas must be provided, and the respectively suitable configuration may be determined by the expert by way of experiments.

As shown in FIGS. 1 to 5, the low-voltage winding 10 is disposed centrally around the core 17 as spaced by a further cooling channel 16. In the embodiments shown in FIGS. 1 to 5, the low voltage winding 10 is constructed without electrodes. For the mutual fixing of the windings, of the insulation torus and of the core, distance or spacer bars 11 are normally used.

Figure 6:
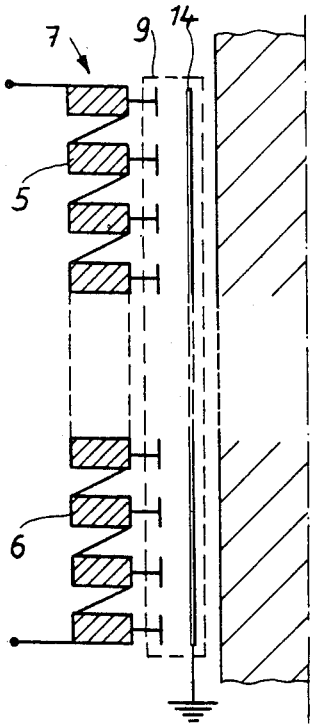
FIG. 6 shows in schematical view an embodiment of an inductor or reactor including a grounded shield.

FIG. 6 shows schematically an embodiment of an inductor or reactor. The winding is divided into winding sections 5, 6, and the electrodes 12 are electrically connected. Furthermore, a grounded shield 14 is provided, with the electrodes and the shield being embedded in an insulation torus 9.

Figure 7:
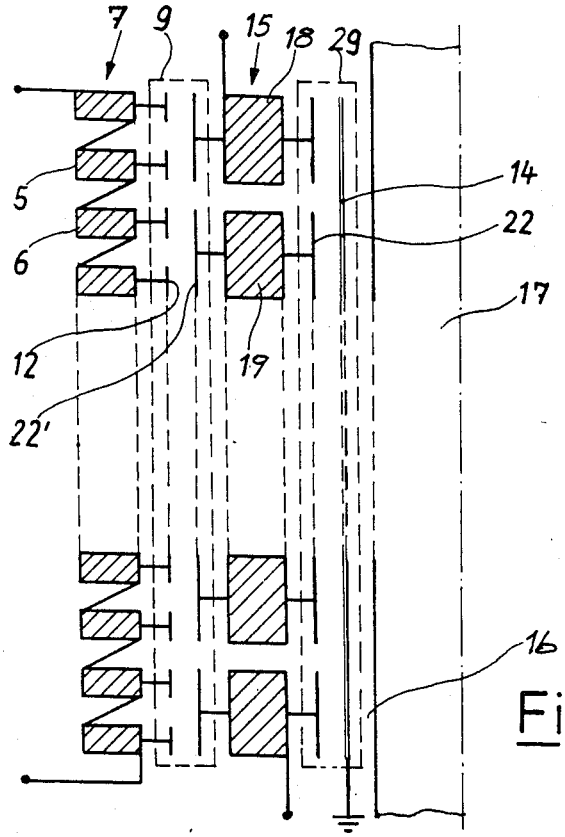
FIG. 7 illustrates an embodiment including a pair of windings and a pair of insulation tori of different configurations and being concentrically arranged around the core.

FIG. 7 illustrates a somewhat more complex winding assembly. In this instance, a pair of windings, namely a high-voltage winding 7 and a medium-voltage winding 15, are provided which are both divided into winding sections 5, 6 or 18, 19, respectively, distributed across the height of the winding.

Both on the proximal side close to the core and on the distal side remote from the core, the winding sections 18, 19 of the medium-voltage winding 15 are provided with electrodes 22, 22' which are embedded in a pair of corresponding insulation tori 9, 29 disposed concentrically around the core 17. In this embodiment, between the core 17 and the core-side (proximal) insulation torus 29 there is provided a cooling channel 16, but no further winding. On the side directed towards the core, i.e. on the core-side, the insulation torus 29 has further embedded therein a grounded shield 14 in a manner to face the electrodes 22. In the distal insulation torus 9, i.e. the one remote from the core, the electrodes 12 of the winding sections of the high-voltage winding and the electrodes 22' of the medium-voltage winding sections face each other.

Figure 8:
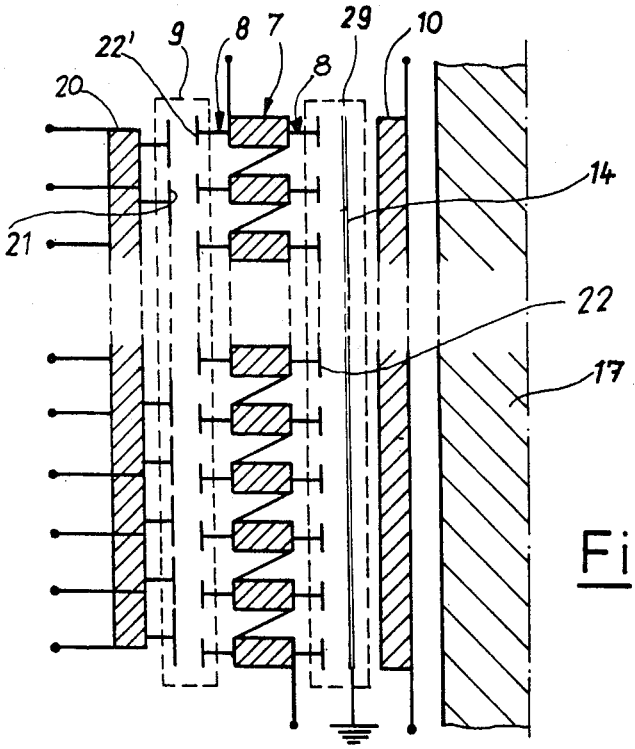
FIG. 8 shows an assembly including control, high-voltage and low-voltage windings and a pair of concentric insulation tori.

FIG. 8 illustrates a phase section 1 in which a low-voltage winding 10, a high-voltage main winding 7 and a high-voltage control winding 20 are provided, with the high-voltage main winding 7 being provided with electrodes 22, 22' both on the proximate and on the distal side, which electrodes are embedded in a pair of concentric insulation tori 9, 29 holding between them the high-voltage main winding with the intermediate of cooling channels 8. The insulation torus 29 has embedded therein the shield 14 at the side closest to the low-voltage winding 7. The control winding 20, the electrodes 21 of which are embedded in the outer insulation torus, includes taps, connected to a not illustrated multiple-contact or stepping switch, for controlling the voltage under load.

Figure 9:
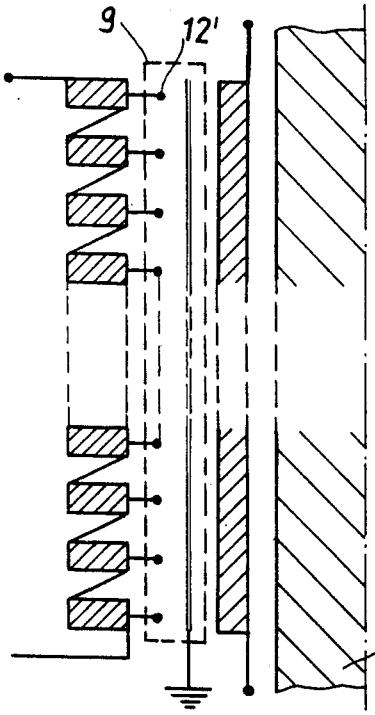
FIG. 9 shows an embodiment in which the electrodes are embodied in the form of rings.

FIG. 9 illustrates, as an embodiment similar to that of FIG. 2, a different form of electrodes 12' which are formed as solid, open rings having a diameter of from about 1 to 3 mm, with the rings, in turn, being embedded in an insulation torus 9.

For improving the voltage distribution across the winding under high voltages, electrodes overlapping each other in the direction of the winding axis are advisable.

Figure 10:
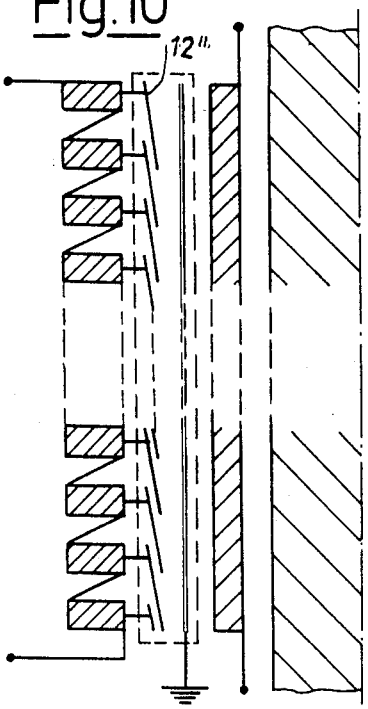
FIG. 10 shows an embodiment including conically formed electrodes overlapping each other in the axial direction of the winding.

FIG. 10 shows an embodiment similar to that according to FIG. 2, but including conically formed, mutually overlapping electrodes 12''.

Figure 11:
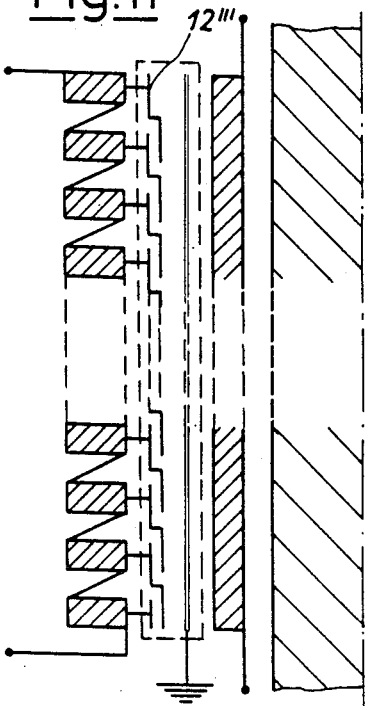
FIGS. 11, 12 and 13 illustrate embodiments of the air-cooled ("dry") transformer, showing different configurations of overlap of the electrodes.

FIG. 11 is a variant of the embodiment of the electrodes according to FIG. 10. In this instance, the electrodes 12''' are shaped as stepped cylinders.

In FIGS. 10 and 11, the electrodes are positioned substantially in a cylindrical surface.

Figure 12:
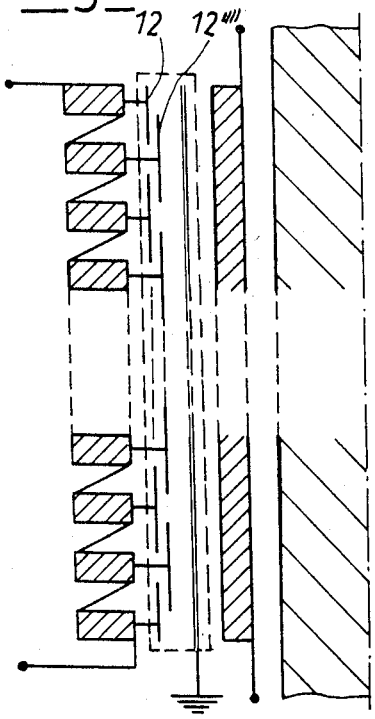

FIG. 12 illustrates an embodiment of the electrode configuration similar to the one of FIGS. 10 and 11. Sequence and arrangement of the electrodes 12, 12'''' are chosen in a manner that these electrodes appear alternately in two cylindrical surfaces.

Figure 13:
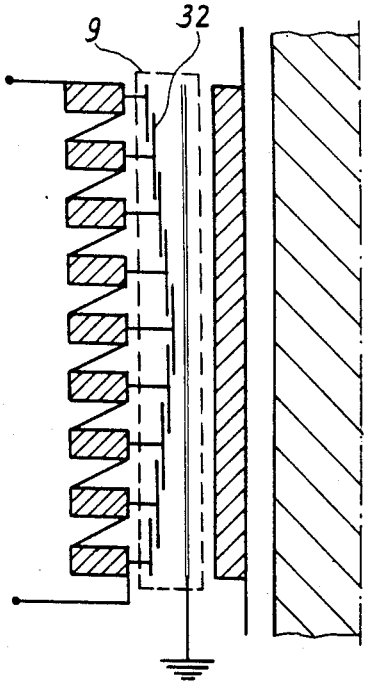

FIG. 13 illustrates a configuration in which the electrodes 32 overlap each other in upward and downward direction in such a manner that they are not aligned with each other within the insulation torus 9, but rather define a staggered roof in cross-section. In this embodiment, the electrodes are disposed in a plurality of cylindrical surfaces.

An analogous arrangement of the electrodes with a reversed type of overlap is likewise possible.

It has to be noted in the illustrations of electrodes 12'', 12''', 12'''' and 32 according to FIGS. 10 to 13 that these electrodes do not involve closed shells, but rather define electrically not closed, ring-shaped portions, with both ends thereof being separated from each other by a slot or overlapping each other with a spacing.

As a modification of the embodiments described above, FIG. 14 shows a winding in which partially overlapping and partially non-overlapping, vertically separated or spaced electrodes 12 or 12' are connected to the individual winding sections 5, 6 or 5', 6', respectively.

FIG. 15 illustrates an embodiment similar to that of FIG. 2, but including a pair of parallel branches 23, 24 within the high-voltage winding 7.

In FIG. 16, there is shown an embodiment including a pair of parallel branches 23, 24 within the high-voltage winding 7, similar to FIG. 15, but having a different electrode configuration 33. The staggering of the electrodes is approximately the same as in a capacitor terminal.

Each electrode 33 has associated therewith in paired arrangement a pair of winding sections 5 or 25 equally spaced from the equator and positioned at one-half of the winding height. In this instance, n/2 electrodes are obtained if n is equal to the number of winding sections, with the inner electrode each overlapping the next outer one, i.e. being longer by about two winding sections.

This embodiment is useful specifically for larger air-cooled transformers bearing higher voltages and having a reduced insulation level at the neutral point.

Figure 17:
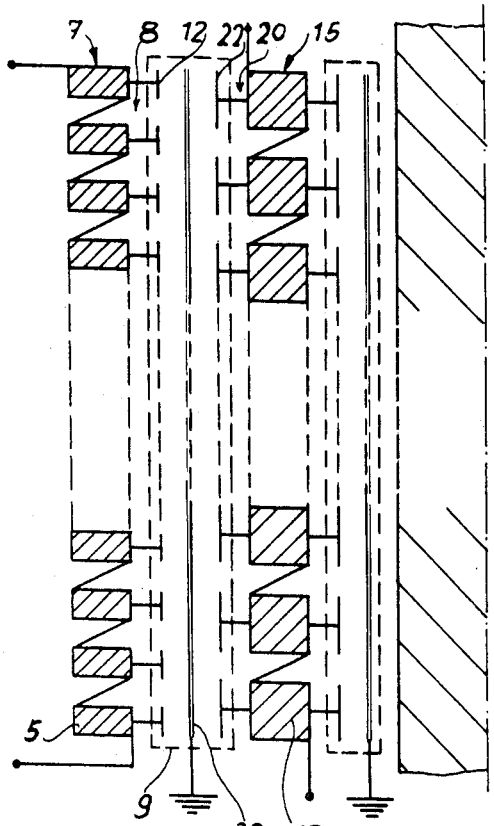
FIG. 17 shows an embodiment similar to that of FIG. 6, but with a grounded shield within the outer insulation torus between the two electrode rows.

FIG. 17 shows an assembly in which electrodes 12, 22' which face each other with electrical isolation within an insulation torus 9, are conductively connected to the two outer and inner adjacent winding sections 5, 18 each separated from the insulation torus by a cooling channel 8, 28. Embedded between the spaced, facing electrodes 12, 22′ is an electrically conductive, grounded shield 30. Shields of this kind may be used for safety reasons. A non-grounded shield in the above-described configuration is suitable, for example, for measuring or test purposes.

Figure 18:
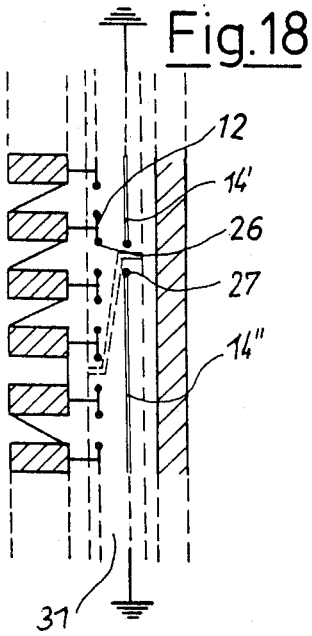
FIG. 18 illustrates an embodiment including an insulation torus composed of a pair of axial components along the height of the winding.

FIG. 18 illustrates an embodiment including an insulation torus 31 composed of two axial portions across the height of the winding, which torus may be assembled substantially without joint. A construction of more than two axial portions is likewise feasible. Furthermore, by proper selection of specific embodiments and shield portions 14′, 14″, the electric field intensity of the joint may be kept extremely low in the vicinity of the partition joint. To this end, the electrodes 12 which are shaped as open annular surfaces, have their edges provided with rounded terminal rings 26 placed thereon.

As further shown, the shield 14 is divided across its height into the pair of part shields 14′, 14″, which, in the present instance, are each grounded individually and, as shown, likewise provided with rounded terminal or connector rings 27.

Figure 19:
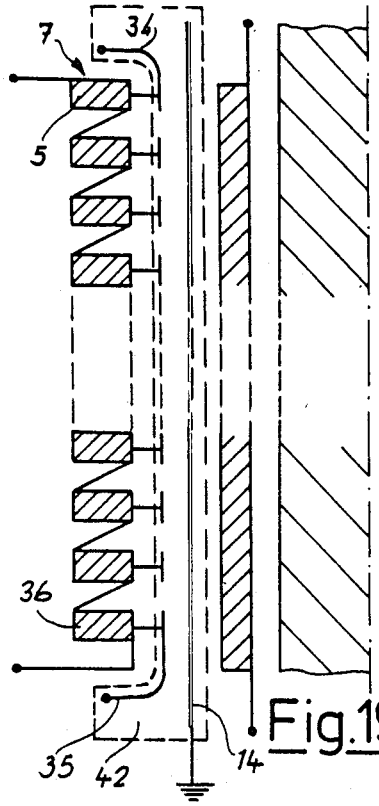
FIG. 19 shows an assembly in which the terminal electrodes are bent outwards at both ends of the high-voltage winding.

FIG. 19 illustrates an embodiment in which the terminal electrodes 34, 35 of the uppermost and lowermost winding sections 5 or 36, respectively, are bent around the head or base, respectively, of the high-voltage winding 7 in the direction of the winding, with these bents, in turn, being embedded in an insulation torus 42 being formed with corresponding flanges. The grounded shield 14 has the normal configuration.

Figure 20:
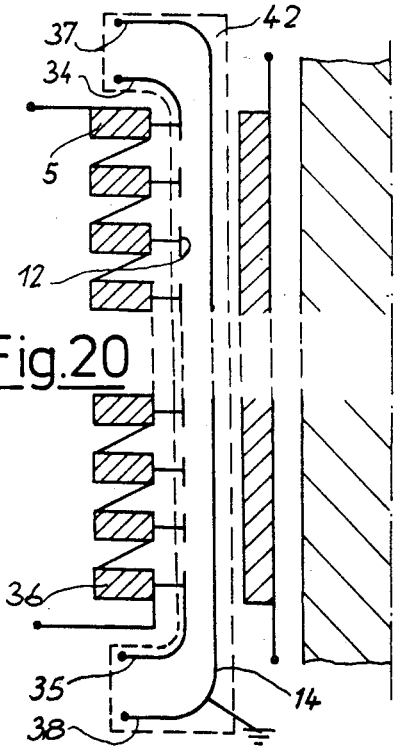
FIG. 20 shows an assembly similar to that of FIG. 19, but additionally with an outwardly bent shield or screen.

FIG. 20 shows an assembly similar to that of FIG. 19, but with ends 37, 38 of shield 14, which are correspondingly bent in parallel with the terminal (end-side) electrodes of the high-voltage winding. The end portions of the insulation torus 42 show a corresponding configuration, too.

Figure 21:
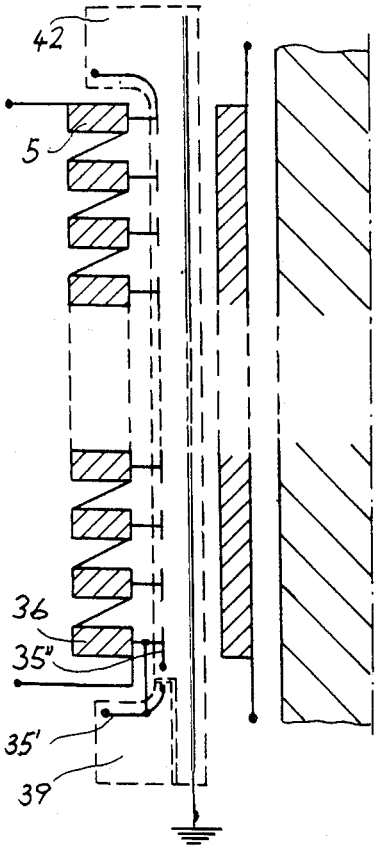
FIG. 21 shows an embodiment similar to that of FIG. 19, but including an insulation torus which has at one end thereof an insulation part additionally provided with an electrode.

FIG. 21 illustrates an embodiment similar to the one according to FIG. 19, but comprising an insulation torus 42 which includes at one end thereof an auxiliary, removable insulation part 39 provided with a part electrode 35′. This part electrode 35′ and the part electrode 35″ disposed within the insulation torus 42 are commonly electrically connected to the winding section 36. At the other end, the insulation torus 42 includes a solid flange, similarly as shown in FIGS. 19 and 20. Both insulation parts, the insulation torus 42 and the insulation part 39 are normally assembled without joint, e.g. by adhesive bonding under a vacuum.

Figure 22:
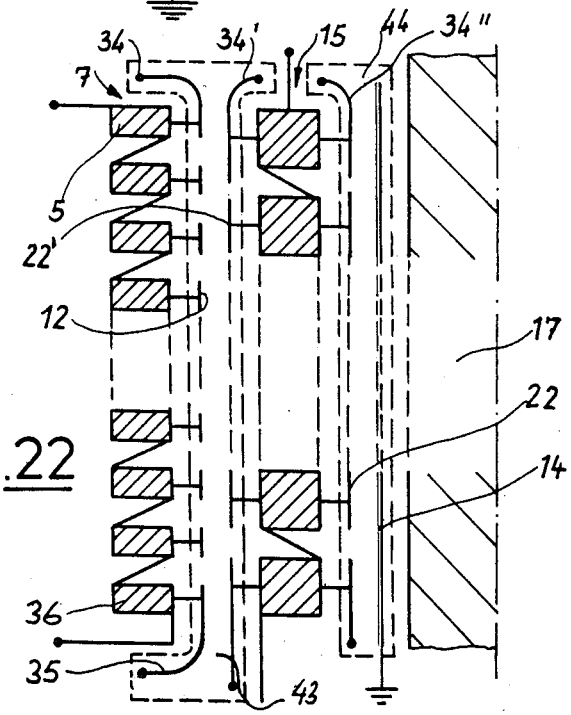
FIG. 22 illustrates an assembly including high-voltage and medium-voltage windings and two insulation tori, with terminal electrodes bent at both ends on the high-voltage side and at only one end of the torus on the medium-voltage side.

FIG. 22 shows an assembly comprising high-voltage and medium-voltage windings 7 and 15, respectively, and a pair of insulation tori 43 and 44. One torus 43 is disposed between high-voltage and medium-voltage windings and equipped with electrodes 12, 22′ of both adjoining windings 7 and 15. The other torus 44 is positioned between the medium-voltage winding 15 and the core 17, with electrodes 22 connected to the winding side of this winding, and with a grounded shield 14 on the core side. At the high-voltage side, terminal electrodes 34, 35 of the uppermost and lowermost winding section 5 and 36, respectively, are bent in the manner as shown in FIG. 19. At the medium-voltage side, one of the terminal electrodes 34′ is bent inwards towards the winding in the outer insulation torus 43, around the head portion of the medium-voltage winding 15. One of the terminal electrodes 34″ in the inner insulation torus 44 is bent outwards around the head portion of the medium-voltage winding.

Figure 23:
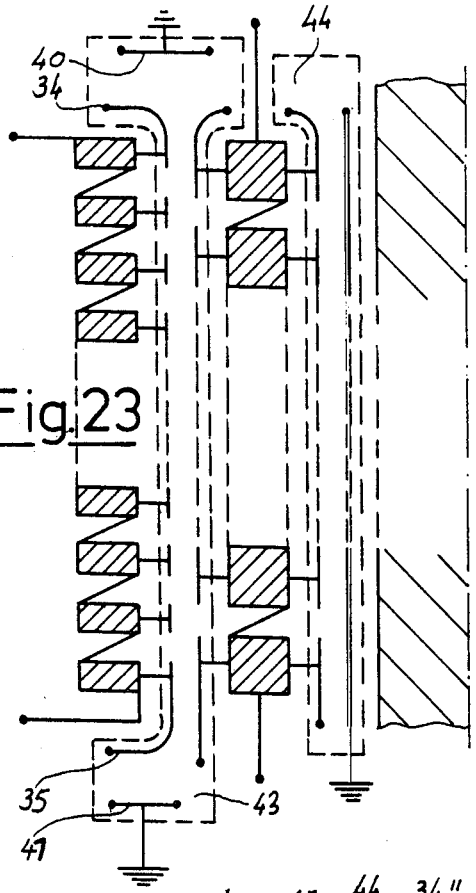
FIG. 23 shows an assembly similar to that according to FIG. 22, but with grounding electrodes embedded at the end of the outer insulation torus.

FIG. 23 shows an assembly similar to that of FIG. 22, but with inserted or inlaid grounding electrodes 40, 41 which are located in the outer insulation torus 43 for improved voltage control toward the end, and which at the end sides are inserted into the insulation torus 43 to oppose the windings.

Figure 24:
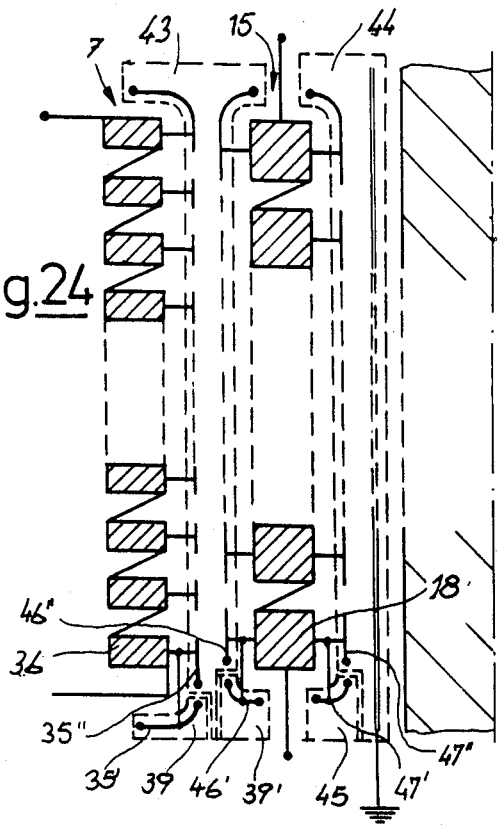
FIG. 24 shows an assembly including high-voltage and medium-voltage windings and a pair of insulation tori with terminal electrodes bent (at angles) at both ends of the tori; the tori being embodied with additional insulation parts on one end, which each include a part electrode.

FIG. 24 illustrates a winding assembly or system similar to that of FIG. 22; in this instance, however, the lower terminal electrodes 35, 46 and 47 are bent towards the proximal windings. These electrodes are different from the upper terminal electrodes 35′, 35″, 46′, 46″ or 47′, 47″. The electrode parts are electrically connected in pairs to the lowermost winding sections 36 or 19 of the high-voltage and medium-voltage windings 7, 15, respectively, close to the electrodes.

The outer insulation torus 43 includes at its lower end a pair of additional insulation parts 39, 39′ matingly contacting the torus, which have each embedded therein a downwardly bent portion 35′ or 46′ of the terminal electrode pair connected to the high-voltage and medium-voltage windings, respectively; in contrast, the inner insulation torus 44 includes at the lower end thereof only one additional insulation part 45 matingly contacting the insulation torus 44 and in which the bent portion 47′ of the terminal part electrode pair connected to the medium-voltage winding is positioned.

The winding assemblies shown in the insulation torus embodiments according to FIGS. 18, 21 and 24, with axial division or with insulation parts closely or matingly contacting the ends of the torus, will be used if required for assembling of the windings.

The additional or auxiliary insulation parts 39, 39′ and 45 shown in FIGS. 21 and 24 may be mounted also to both sides of the insulation tori 42, 43 and 44.

Figure 25:
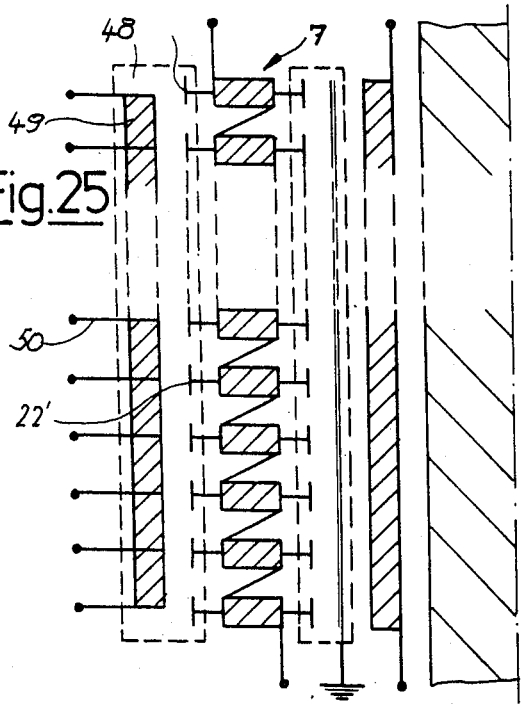
FIG. 25 shows an assembly including control, high-voltage and low-voltage windings and a pair of insulation tori, with the outermost torus including not only electrodes of the high-voltage side, but also a control winding.

FIGS. 25 illustrates a winding assembly similar to that of FIG. 8. Embedded in the body or compound of the insulation torus 43 is, in addition to the electrodes 22′ electrically connected to the high-voltage winding 7, a winding spaced and electrically separated from these electrodes, in the present instance a control winding 49 which is formed without electrodes. The control winding 49 includes taps 50 which are connected to a stepping switch (not shown) for voltage control under load.

Figure 26:
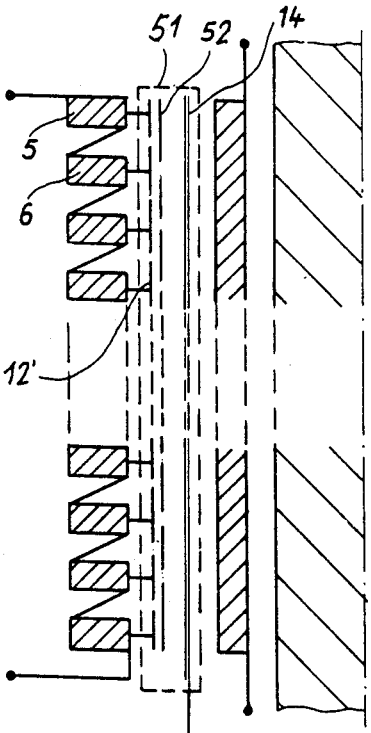
FIG. 26 shows an embodiment similar to that of FIG. 2, but with electrically separated or isolated auxiliary electrodes.

Also, FIG. 26 shows a variation of the embodiments described above. As in FIGS. 10 to 13, in this arrangement the electrodes 12, 51 are formed to overlap each other, in order to improve the surge voltage distribution across the high-voltage winding. In contrast with the assembly shown in FIGS. 10 to 13 and including electrodes electrically connected to the winding sections, and which are directly capacitively coupled to each other by order, the capacitive coupling between adjoining electrodes 12 connected to the winding sections is effected, in the embodiment of FIG. 26, by means of a series of relatively insulated electrodes 52 disposed adjacent to the electrodes 12 and not electrically coupled thereto. In the present instance, insulation between high and low voltage is effected in the insulation torus between the series of the electrodes 12, 52 embedded in the insulation torus, and a grounded shield 14 which is likewise embedded in the insulation torus 51. Preferably, these electrodes 52 are formed as non-closed circular rings.

The disclosed principles of design may be applied not only to air-cooled transformers for distribution networks and to air-cooled miniature inductors or reactors, but also to larger steam-cooled transformers, largesize inductors, transducers and special constructions of apparatus of this type.

We claim:

1. A winding system in a gas-cooled transformer, comprising:

at least one winding divided into separate winding sections along the height of the winding;

at least one insulation torus spaced from the winding forming a gas-containing cooling channel between the winding and the insulation torus such that the gas directly cools the winding, the insulation torus comprising a mass of insulating compound;

electrodes embedded in the insulating compound of the insulation torus;

an electrically-conductive, non-magnetic shield embedded in the insulating compound of the insulation torus on the side of the electrodes opposite the winding, spaced from the electrodes for electrical isolation therefrom, at least almost extending around the winding and along the height thereof, and having electrically-conducting means connected to a ground for reducing electric field intensity at the side of the insulation torus opposite the winding, each electrode being electrically connected at least to one of the separate winding sections of the winding and disposed between that winding section and the shield for suppressing electric field intensity in the gas-containing cooling channel between the winding and the insulation torus.

2. The winding system according to claim 1, wherein the winding has a pair of parallel branches (23, 24) at opposite halves along the winding height and the electrodes (33) are connected to a pair of winding sections (5, 25) equally spaced along the parallel branches and progressively remote from the winding with the inner one each being overlapped by the next outer one.

3. The winding system according to claim 1, and further comprising a second insulation torus spaced from the opposite side of the winding from that first-mentioned with electrodes (22) correspondingly embedded therein.

4. The winding system according to claim 1, wherein the electrode (34, 34', 34'', 35, 35', 46', 47') connected to the uppermost or lowermost winding section along the height of the winding is bent around the head or base of that winding section.

5. The winding system according to claim 1, and further comprising a grounded electrode (40, 41) embedded in the insulation compound at one end of the insulation torus (43).

6. The winding system according to claim 1, wherein the shield is bent around at least one end of the winding.

7. The winding system according to claim 1, and further comprising an additional insulation part (39, 39', 45) contacting the insulation torus at one end thereof and having embedded therein an electrode (35', 46', 47) bent around the adjacent winding end and electrically connected to the winding section (36, 8) thereat.

8. The winding system according to claim 1, and further comprising a second insulation torus (48) on the opposite side of the winding (7) from that first mentioned and having embedded therein a second winding (49) which faces second electrodes (22') also embedded therein at an electrically-separating spacing therefrom, the second electrodes being between the windings but electrically-connected only to the first-mentioned winding the second winding being formed without electrodes (FIG. 25).

9. The winding system according to claim 1, and further comprising further electrodes embedded the insulation torus (51) so as to be close to the electrodes (12') first mentioned and farther from the winding (5, 6), the further electrodes (52) spacedly overlapping between the first-mentioned electrodes (12') in the direction of the winding height and not being electrically connected.

10. The winding system according to claim 1, and further comprising:

a second winding divided into separate winding sections along the height thereof on the opposite side of the insulation torus from the winding first mentioned and electrodes embedded in the insulating compound of the insulation torus, electrically connected to the winding sections of the second winding, and on the opposite side of the shield from the electrodes first mentioned.

11. The winding system according to claim 1, wherein the insulation torus (31) and shield (14', 14'') are formed in portions along the height of the winding with the parting joint (27) between the shield portions (14', 14'') positioned at a place along the height of the winding having a lower electric field intensity than other points along the winding.

* * * * *